United States Patent [19]

Chumanov et al.

[11] 4,204,416

[45] May 27, 1980

[54] METHOD OF ROLLING SECTION BILLETS

[76] Inventors: Julian M. Chumanov, ulitsa Rozy Ljuxemburg, 65, kv. 33; Vyacheslav F. Gubaidulin, ulitsa Schorsa, 23, kv. 16; Grigory M. Shulgin, ulitsa Izjumovskaya, 5, kv. 232, all of Donetsk; Viktor I. Pogorzhelsky, Mironovskaya ulitsa, 26, kv. 57; Vasily P. Morozov, ulitsa Leninskaya, 42, kv. 64, both of Moscow; Pavel A. Levichev, ulitsa Orbyty, 152; Jury P. Lyashenko, Universitetskaya ulitsa, 58, kv. 53, both of Donetsk; Anatoly G. Shalimov, Semenovskaya naberezhnaya, 3/1, korpus 6, kv. 218; Dmitry P. Evteev, ulitsa Chelyabinskaya, 10/2, kv. 137, both of Moscow; Sergei P. Efimenko, bulvar Pushkina, 25, kv. 34, Donetsk; Stanislav N. Ignatiev, ulitsa Saratovskaya, 24, Donetsk; Vladimir P. Slednev, ulitsa Artema, 147 V, kv. 35, Donetsk; Eduard V. Ovsy, bulvar Shevchenko, 19, kv. 32, Donetsk; Vladimir S. Solod, bulvar Franko, 46, kv. 69, Donetsk; Valery V. Moiseenkov, ulitsa Postysheva, 135, kv. 24, Donetsk, all of U.S.S.R.

[21] Appl. No.: 862,642

[22] Filed: Dec. 20, 1977

[51] Int. Cl.[2] ..... B21B 1/02

[52] U.S. Cl. ..... 72/204; 72/221; 72/366; 72/234

[58] Field of Search ..... 72/235, 234, 221, 226, 72/203, 204, 366

[56] References Cited

U.S. PATENT DOCUMENTS

| | | | |
|---|---|---|---|
| 885,508 | 4/1908 | McKee | 72/366 X |
| 1,977,285 | 10/1934 | McCleery | 72/235 X |

*Primary Examiner*—Milton S. Mehr

*Attorney, Agent, or Firm*—Lackenbach, Lilling & Siegel

[57] ABSTRACT

The invention relates to a method of rolling section billets in which billets interconnected by bridges are successively formed from a slab in a number of grooves defined by a plurality of transversely juxtaposed passes, with subsequent separation of billets from one another by effecting a relative displacement of adjacent billets by prevailingly acting with a groove on one of the sides of the adjacent billets at an angle other than 90° to the roll axis when the bridge thickness becomes equal to 0.01–0.3 of the groove height.

6 Claims, 19 Drawing Figures

METHOD OF ROLLING SECTION BILLETS

BACKGROUND AND SUMMARY OF THE INVENTION

The invention relates to metal forming, and more particularly to a method of rolling section billets.

The invention may be utilized where continuous casting machines are used in combination with a rolling mill in the manufacture of section billets of ferrous or non-ferrous metals. The invention may also be used in roughing stands of section and wire mills and in continuous billet rolling mills.

In the majority of industrially developed countries in the world, there is a permanent shortage of finished section rolled stock which is manufactured of section billets. This is due, on the one hand, to the development from metal consuming industries, and on the other hand, to insufficient output of rolling mills manufacturing section billets. Constant demand for section billets requires an increase in the output of reducing and billet rolling mills. Therefore, a problem arises of providing new manufacturing processes for the production of section billets.

Such manufacturing processes should, first, reduce the production cost of the rolling; second, improve the output of rolling mills; and third, enable a combination of a continuous casting machine and a reducing mill in a single production line.

A conventional production system presently employed for rolling section billets comprises: an ingot-blooming-continuous billet rolling mill. However, all known methods of improving the output of section billets using this production system have reached their limit. An important disadvantage of the conventional system resides in a large metal consumption rate.

In industrially developed countries, up to 20% of the total volume of steel produced is manufactured by continuous casting methods. However, low casting, speeds and hence low productivity, as well as non-uniformity of metal properties over the cross-section and the length of the ingot hamper the production of section billets in continuous casting machines.

Known in the art is a method of making billets, in which a slab having a high width-to-height ratio is produced in a continuous metal casting plant. After complete solidification, the slab is cut apart transversely by using gas cutting torches into individual billets, thereby eliminating reducing and billet rolling.

This method has, however, a number of disadvantages including a large metal consumption rate due to metal losses in gas cutting, and also the billets are of poor quality due to the phase separation on the surface upon transversely cutting the slab.

Also known in the art is a method of splitting triple billets by rolling them between rolls having relatively eccentrical grooves cut along a helical line.

This method involves practical difficulties due to the problems arising in cutting grooves and installing fittings. In addition, the application of this method is limited to the separation of no more and no less than three billets.

Another known process is a method of continuously making section billets comprising subjecting a continuous slab leaving a mould to a successive reduction between a series of cailbrated rolls until complete solidification. As a result of deformation of the wider sides, the slab takes a shape of a plurality of interconnected square billets. After secondary cooling with sprayed water, the billets are cut lengthwise and transversely to obtain measure lengths.

One of the disadvantages of this method resides in low quality of separation zones when using thermal cutting or cutting with circular saws, and where gas cutting is used, metal consumption increases.

Known in the art is a method of making twin billets, in which a continuously cast rectangular-section slab is rolled between a number of twin grooves arranged in series, the cross-sectional shape of the grooves gradually approximating a square or rhombus. The resultant billets are then cut apart by means of gas cutters.

This method is closer in its concept to the conventional rolling in cut grooves, however, the method of cutting is uneconomical due to considerable metal consumption.

It is also known to manufacture section products by the rolling of wide billets in transversely juxtaposed grooves. As a result of billet reduction, a multiple billet is formed which consists of two or more section billets interconnected by bridges of reduced section. The section billets are separated from one another by causing a vertical displacement of the section billets relative to one another. The separation may be effected in both the hot and cold state.

The known method also has disadvantages, and most important among them is low quality of portions of the billets adjacent to cutting zones due to the presence of burrs.

It is an object of the invention to eliminate the above-mentioned disadvantages.

Still another object of the invention is to provide a method of rolling which not only increases the output of rolling mills in the manufacture of section billets, but also utilizes a continuous metal casting machine and a reduction mill as an integral production unit. The method of the invention also reduces production cost of the section billets, facilitates automation of the rolling mill and improves quality of the billets.

These and other objects are accomplished by a method of rolling section billets comprising successively forming billets of a slab in a number of grooves defined by a plurality of transversely juxtaposed grooves, the billets being transversely interconnected by bridges, and separating the billets from one another, when the thickness of the bridge becomes equal to 0.01–0.3 of the groove height. The adjacent billets are displaced relative to one another by acting with the groove prevailingly on one of the sides of the adjacent billets at angle other than 90° to the roll axis.

Using this method, section billets having a high surface quality may be produced, the output of rolling mills is improved, and the production cost of section billets is reduced.

In accordance with one embodiment of the invention, at least one more displacement of the billets is effected in the direction opposite to the initial displacement.

This facility improves quality of section billets in the zones of their separation from one another since there are no burrs, and the angles at vertexes of the billets are rounded.

The relative displacement of adjacent billets is preferably effected in a direction at right angle to the reduced sides; and the adjoining portions of the adjacent billets which are formed by juxtaposition of sides of the adjacent billets and define bridges, serve as pilot surfaces for displacement.

This facility provides for high-quality separation of billets from one another and eliminates metal losses for bridges.

In accordance with another embodiment of the invention, the billets may be displaced relative to one another also in the direction of their longitudinal axes.

This enables a reduction in the number of passes required to separate the billets from one another, which is an improvement in the output of rolling mills; and quality of the separation zones of the billets is also enhanced.

Still another embodiment of the invention resides in the fact that the amount of relative displacement of adjacent billets is increased for the billets remote from the middle of the groove.

Thus, billets can be separated from one another in a single pass so that the total rolling cycle is reduced, and output of the rolling mills improved.

Further embodiments of the invention involve a simultaneous displacement of several adjacent billets by one the same amount before the relative displacement of adjacent billets.

This facility permits the billets to be separated from one another in a maximum of two passes. Yet another embodiment of the invention resides in that the direction of prevailing action with the groove on the sides of the billets located on different sides of the middle of the groove intersect at an angle of 90°.

This succession of steps enables the elimination of axial forces in the groove, thereby improving the accuracy of the billets being produced and enhancing the gripping conditions.

BRIEF DESCRIPTION OF THE DRAWINGS

The invention will now be described with reference to specific embodiments thereof illustrated in the accompanying drawings, in which.

Several embodiments of the method of rolling section billets will be described.

DESCRIPTION OF THE PREFERRED EMBODIMENTS

Figure 1:
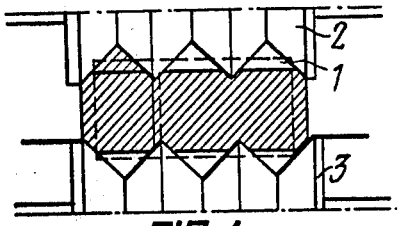
FIG. 1 diagrammatically shows rolling in a multipass groove—first pass.
Figure 2:
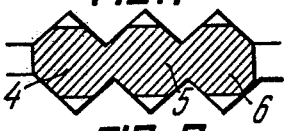
FIG. 2 shows the same diagram as in FIG. 1—second pass.
Figure 3:
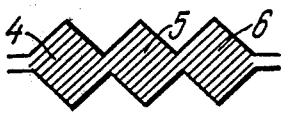
FIG. 3 shows the same diagram as FIG. 2—third pass.
Figure 4:
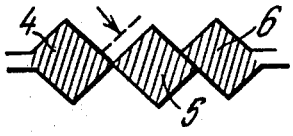
FIG. 4 diagrammatically shows separation of billets from one another.

A slab 1 (FIG. 1) of rectangular cross-section is fed to rolls 2 and 3 with a multipass groove. The multipass groove is defined by three transversely juxtaposed square passes. By rolling the slab 1 in the three-pass groove in four passes (FIGS. 1–4), billets 4, 5 and 6 are formed which are interconnected transversely by bridges. Concurrently with the formation of the billets 4, 5 and 6, the thickness of bridges therebetween is also reduced. The deformation conditions are calculated in such a manner that in the leader pass (FIG. 3), the thickness of the bridge should be equal to 0.01–0.3 of the groove height, and the billets 4, 5 and 6 should be formed. The finishing pass is made in such a manner (FIG. 4) that its middle groove should be shifted relative to the lateral grooves by an amount at least equal to the bridge thickness (see reference arrow in FIG. 4). By rolling the billets 4, 5 and 6 in this pass, the lateral billets 4 and 6 are reduced by a small amount. As a result of the action with a groove on one side thereof, the middle billet 5 is displaced relative to the billets 4 and 6. The relative displacement of the billets 4, 5 and 6 is effected at an angle which is equal to the angle of inclination of the groove sides to the axis of the roll 3, that is at an angle other than 90°.

Figure 5:
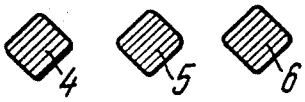
FIG. 5 shows section billets obtained by multipass rolling.

As a result of reduction of the billet 5 at one side, the deformation of the billet 5 initially occurs in the reducing direction. Then, when the average specific metal pressure on the rolls 2 and 3 exceeds admissible shear stress for a given steel grade, the middle billet 5 is displaced relative to the lateral billets 4 and 6 thereby breaking the bridge, and the billets 4, 5 and 6 (FIG. 5) are separated from one another.

In case it is required to obtain section billets with rounded angles at vertexes, the following technique is applied: after the relative displacement of adjacent billets, one more displacement of billets is effected, before the bridge is broken, in the direction opposite to the initial displacement.

Figure 6:
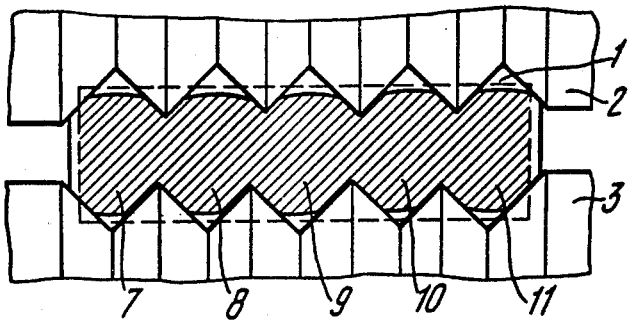
FIG. 6 diagrammatically shows rolling of a slab in a five—pass groove.
Figure 7:
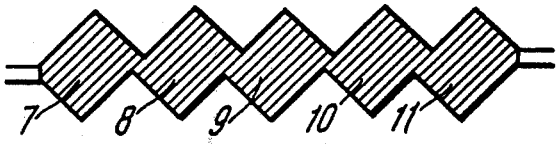
FIG. 7 diagrammatically shows the arrangement of billets before their separation lengthwise.

As shown in FIG. 6, five billets 7,8,9,10 and 11 of rectangular section are formed from the slab 1 in rolls 2 and 3 in several passes in multipass grooves. The billets 7,8,9,10 and 11 (FIG. 7) are interconnected by bridges of a thickness equal to 0.01–0.3 of the groove height. In a multipass groove 12 (FIG. 8), the grooves are made in such a manner that the billets 8 and 10 are displaced relative to the billets 7, 9 and billet 11 by an amount smaller than the bridge thickness, that is no breakage of bridges occurs in the groove 12. The billets 8 and 10 are displaced relative to the billets 7, 9 and 11 by acting with the groove 12 on the smaller side of the billets 8 and 10. It should be noted that as the short side of the billets 8 and 10 is inclined at an angle less than 90° to the roll axis, the displacement of the billets 8 and 10 also occurs at the same angle.

Figure 8:
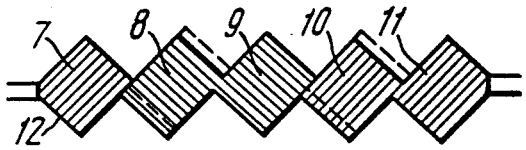
FIG. 8 shows a pattern of displacement of billets relative to one another.
Figure 9:
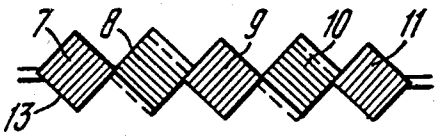
FIG. 9 shows a pattern of displacement of billets in the direction opposite to the initial displacement.
Figure 10:
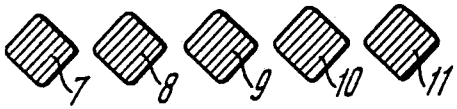
FIG. 10 shows billets obtained by two displacements in opposite directions.

After the rolling of the interconnected billets 7,8,9, 10 and 11 in the multipass groove 12, they are then rolled in a multipass groove 13 (FIG. 9). The groove 13 is made in the rolls 2 and 3 of the rolling mill, and its passes are made in such a manner that in rolling the interconnected billets 7,8,9,10 and 11, the billets 8 and 10 are prevailingly reduced at the smaller side. But it should be born in mind, that the reduction is effected at those smaller sides of the billets 8 and 10 which had not been reduced in the preceding groove 12 (FIG. 8). In other words, the direction of displacement of the billets 8 and 10 in the groove 13 (FIG. 9) is changed to the opposite compared to the preliminary displacement in the groove 12 (FIG. 8). It is noted that the billets 7,9 and 11 are not displaced relative to one another. The displacement of the billets 8 and 10 in the multipass groove 13 (FIG. 9) is effected by an amount at least equal to the thickness of bridge between the billets 7,8,9,10 amd 11 in the groove 12 (FIG. 8). In other words, the relative displacement of the billets is effected in the groove 12, while an opposite displacement is effected in the groove 13 (FIG. 9). This succession of steps—displacement/opposite displacement—enables the cutting of bridges between the billets and separation of billets from one another. The surface of the billets 7,8,9,10 and 11 in the separation zones is of good quality, and vertexes of the billets 7,8,9, 10 and 11 (FIG. 10) at the separation zones are rounded due to the necking motion of metal.

In the above-described embodiments, the relative displacement of adjacent billets is effected in the direction at right angle to the sides being reduced. The interconnected positions of the adjacent billets are formed by juxtaposition of sides of the adjacent billets and define bridges (so called virtual bridges). This facility provides for lengthwise separation without any waste. The process will be discussed herein in detail.

The multipass groove in which separation of the billets 4, 5 and 6 from one another is not effected (FIG. 3), is cut in the rolls 2 and 3. The sizing is so circulated that the sides of the adjacent billets 4,5 and 5,6 are aligned along one straight line after a pre-set thickness of bridges is achieved. This means that the adjacent billets 4,5 and 5,6 are juxtaposed with their sides, and this juxtaposition defines the bridge between the billets. In the next pass (FIG. 4), the interconnected portions serve as guides in the displacement of the billet 5 relative to the billets 4 and 6.

The sides of the adjacent billets 4,5 and 5,6 may be aligned along one straight line by axially displacing the work rolls 2 and 3 before the rolling by the amount equal to $$\Delta = h_1 \text{ Sin } \varphi/2$$

wherein, $h_1$ is thickness of the bridge in the pass before separation;

$\varphi$ is the angle at the vertex of the groove in the pass before separation.

The amount of relative displacement of the rolls equal to $$\Delta = h_1 \text{ Sin } \varphi/2$$

depends on the fact that, prior to reduction of one of the sides of the middle billet, the sides of the two adjacent billets are in one straight line. The amount $\Delta$ ensures that the sides of the adjacent billets are in one straight line.

Figure 11:
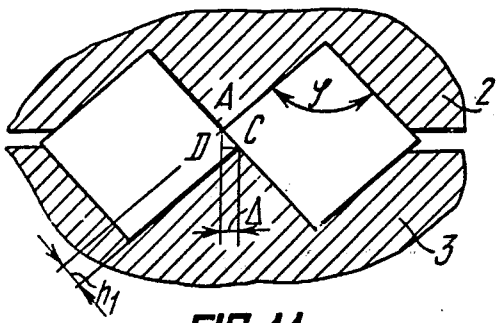
FIG. 11 diagrammatically shows a multipass groove having juxtaposed portions of sides of adjacent grooves.

The distance between the vertical axes of collars of the upper roll 2 and the lower roll 3 is determined from the diagram (FIG. 11). From the triangle ACD, the amount $\Delta$ is determined, the points A and C of the sides of the adjacent billets being in one straight line.

$$\Delta = DC = AC \text{ Sin } (\varphi/2) = h_1 \text{ Sin } (\varphi/2) \text{ (square section billets).}$$

If the billets are simultaneously axially displaced and reduced for every second billet at the side, that is displaced transversely during the process of the separation of billets from one another, surface quality of the billets in the separation zones is improved, and the number of passes needed to separate the billets is reduced.

Figure 12:
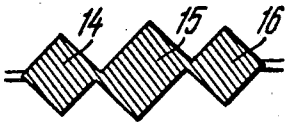
FIG. 12 diagrammatically shows rolling of billets of different cross-sectional shape.
Figure 13:
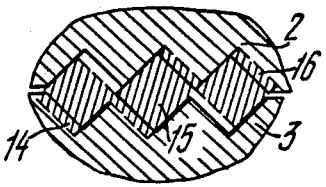
FIG. 13 diagrammatically shows separation of billets by displacing them along billet axes and at right angle thereto.

This method is applied for rolling billets 14,15,16 (FIG. 12) in a three-pass groove with square passes. The billets 14,15,16 are interconnected by bridges of a thickness equal to 0.02 of the groove height. The cross-sectional area of the billet 15 is 1.3 times greater than that of the billets 14,16, but all billets are of rectangular cross-section. The billets 14 and 16 are prevailingly reduced at one of the sides thereof in a deformation source provided by the rolls 2 and 3 (FIG. 13). As a result, since the lateral grooves of the upper roll 2 and lower roll 3 have an empty room, the billets 14 and 16 are displaced relative to the billet 15. However, as the stretching of the billet 15 is much greater than that of the billets 14 and 16, and the metal does not substantially flow over the bridge, the billets are separated under the concurrent action of two stresses, namely, longitudinal and transversal shear.

If the starting slab is of a large width, which may be the case when making slabs in continuous metal casting machines, a large number of section billets may be formed therefrom (five-thirteen billets). In such case, the amount of relative displacement of adjacent billets is preferably increased for the billets remote from the middle one. This facility enables separation of the billets from one another in a single pass.

Figure 14:
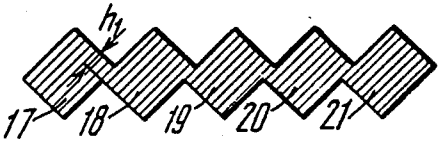
FIG. 14 shows billets interconnected by bridges of equal thickness.

During rolling, five billets 17,18,19,20 and 21 (FIG. 14) are formed from one slab. The forming is effected until the billets 17–21 acquire the cross-sectional shape approximating a square. The thickness of the bridges between the billets $h_1$ is 0.01–0.3 of the groove height. The sides of the adjacent billets 17–21 are in one straight line.

Figure 15:
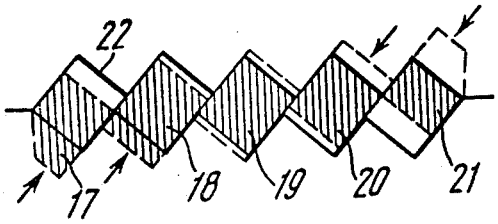
FIG. 15 diagrammatically shows separation of a quintuple billet.

Subsequently, the interconnected billets 17–21 are rolled in a groove 22 (FIG. 15). Here, the billet 19, which is slightly reduced, is held fixed, while the adjacent billets 18 and 20 are displaced relative thereto by an amount which is at least equal to the bridge thickness. At the same time, the billets 17 and 21 are displaced relative to the billets 18 and 20 by an amount of one bridge, hence they are displaced relative to the billet 19 by an amount of two bridges. Therefore, moving away from the central billet (19), the amount of displacement of the billets increases.

In case it is necessary to roll and separate a large number of billets in a continuous billet rolling mill, it is very effective to displace several billets by the same amount before the relative displacement of adjacent billets.

Figure 16:
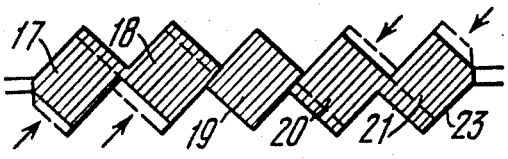
FIG. 16 diagrammatically shows splitting of a quintuple billet into three billet groups.
Figure 17:
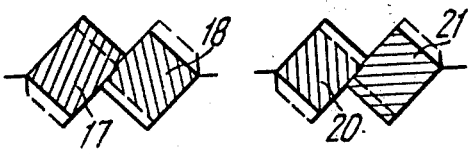
FIG. 17 diagrammatically shows final separation of billets from one another.

Thus, during rolling, five square billets 17–21 (FIG. 16) interconnected transversely by bridges are formed from a starting slab. Thickness of bridges for all the billets is the same and equal to 0.01–0.3 of the groove height. Subsequently the above-mentioned billets 17–21 are rolled in a multipass groove 23 (FIG. 16). By holding the billet 19 fixed, the billets 17 and 18 are displaced relative thereto, as well as the billets 20 and 21. The displacement of the billets 17,18,20 and 21 is effected by the same amount which is at least greater than the bridge thickness. It is noted that as the billets 17 and 18, 20 and 21 are displaced by the same amount, there is no relative displacement taking place between the billets 17, 18 and 20, 21. This means that the billets 17–21 are separated in the groove 23 into three groups: the first group—interconnected billets 17 and 18; the second group—the billet 19; and the third group—interconnected billets 20 and 21. Then the first and third groups are rolled. The billet 17 (FIG. 17) is displaced relative to the billet 18, and the billet 20 is displaced relative to the billet 21 until the billets are completely separated from one another.

Figure 18:
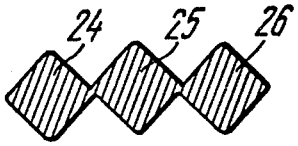
FIG. 18 shows three interconnected billets.
Figure 19:
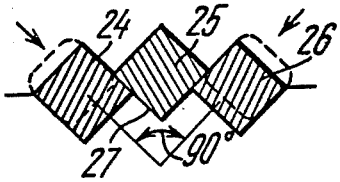
FIG. 19 diagrammatically shows displacement of the billets shown in FIG. 18.

In case it is necessary to roll and separate relatively small number of billets, e.g. three billets, billets 24, 25 and 26 (FIG. 18) are formed by rolling, which are interconnected by bridges so that they are located on one side of a horizontal diagonal line of the billet 25. All billets 24, 25 and 26 are square in shape and interconnected by bridges of a thickness equal to 0.01–0.3 of the groove height. In a multipass groove 27 (FIG. 19), the groove 27 acts on the lateral sides of the billets 24 and 26 to displace them relative to the billet 25. As a result of displacement of the billets 24 and 26 by an amount exceeding the bridge thickness, the bridges are shorn, and the billets 24, 25 and 26 are separated from one another. Since the groove 27 is symmetrical relative to the vertical axis extending through the center of the billet 25, there are substantially no axial forces applied to the rolls. As the sides of the billets 24 and 26 intersect at an angle 90° when extended, the directions of the action of the groove 27 on the reduced sides of the billets 24 and 26 intersect at the same angle.

What is claimed is:

1. A method of rolling section billets having opposing sides from a slab using milling rolls with multipass grooves and having roll axes transverse to the billets comprising: successively forming a plurality of adjacent billets transversely interconnected by bridges in a number of grooves defined by a plurality of transversely juxtaposed passes; and separating said billets from one another by effecting a relative displacement by an amount at least equal to the bridge thickness between said adjacent billets by acting with a groove of a milling roll on one of the sides of said adjacent billets at an angle to the roll axis other than 90° after the thickness of said bridge becomes equal to 0.01–0.3 of the height of said groove and said adjoining portions of said adjacent billets constituting extensions of one another and being in a straight line and defining the bridges, serve as pilot surfaces for the relative displacement along shearing planes, and the separation of said billets being accomplished by shearing forces transmitted through one side of a billet with the side of another adjacent billet acting as a guide support; and whereby burrs are substantially eliminated.

2. A method of rolling section billets according to claim 1, wherein a plurality of displacements of said billets are effected, one of which displacements is in a direction opposite to an initial direction.

3. A method of rolling section billets according to claim 1, wherein said billets are additionally displaced in the direction of their longitudinal axes.

4. A method of rolling section billets according to claim 1, wherein the amount of relative displacement of said adjacent billets is increased for the billets remote from a middle billet.

5. A method of rolling section billets according to claim 1, wherein the relative displacement of said adjacent billets is preceeded by a simultaneous displacement of several billets by the same amount.

6. A method of rolling section billets according to claim 1, wherein said relative displacement being displacement of outer billets relative to a center billet in directions which intersect an an angle of 90.

* * * * *